US010706784B2

(12) United States Patent
Kim et al.

(10) Patent No.: US 10,706,784 B2
(45) Date of Patent: Jul. 7, 2020

(54) STAGE CIRCUIT AND SCAN DRIVER USING THE SAME

(71) Applicant: Samsung Display Co., Ltd., Yongin-si, Gyeonggi-do (KR)

(72) Inventors: Sung Hwan Kim, Yongin-si (KR); Bon Yong Koo, Yongin-si (KR); Sun Kwang Kim, Yongin-si (KR); Chong Chul Chai, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 44 days.

(21) Appl. No.: 15/950,516

(22) Filed: Apr. 11, 2018

(65) Prior Publication Data

US 2019/0019462 A1 Jan. 17, 2019

(30) Foreign Application Priority Data

Jul. 17, 2017 (KR) ..... 10-2017-0090404

(51) Int. Cl.
*G09G 3/3266* (2016.01)
*G09G 3/36* (2006.01)

(52) U.S. Cl.
CPC ..... *G09G 3/3266* (2013.01); *G09G 3/3677* (2013.01); *G09G 2310/0286* (2013.01); *G09G 2310/0289* (2013.01); *G09G 2310/06* (2013.01); *G09G 2310/08* (2013.01)

(58) Field of Classification Search
CPC .. G09G 3/3266; G09G 3/3674; G09G 3/3677; G09G 2310/0286; G09G 2310/06; G09G 2310/08; G09G 2310/0289
See application file for complete search history.

(56) References Cited

U.S. PATENT DOCUMENTS 7,283,603 B1 * 10/2007 Chien ..... G11C 19/00 345/100
2004/0227718 A1 * 11/2004 Park ..... G09G 3/3677 345/100
2007/0040771 A1 * 2/2007 Chung ..... G11C 19/00 345/76
2012/0133626 A1 * 5/2012 Chung ..... G09G 3/3648 345/208
2016/0247479 A1 * 8/2016 Cho ..... G09G 3/3677
2016/0351160 A1 * 12/2016 In ..... G09G 3/3225
2017/0084222 A1 * 3/2017 Sun ..... G09G 3/32

* cited by examiner

*Primary Examiner* — Jimmy H Nguyen
(74) *Attorney, Agent, or Firm* — Lewis Roca Rothgerber Christie LLP

(57) ABSTRACT

A stage circuit includes an output circuit configured to supply, to a first output terminal, a first clock signal supplied to a second input terminal or to supply a voltage of a second power source supplied to a second power input terminal, in response to voltages of a first node and a second node, an input circuit configured to control voltages of a third node and a fourth node in response to a shift pulse or a gate start pulse supplied to a first input terminal, a third clock signal supplied to a third input terminal, and a fourth clock signal supplied to a fourth input terminal, and a first driver configured to control the voltages of the first and second nodes in response to both the third clock signal and the voltages of the third and fourth nodes.

18 Claims, 8 Drawing Sheets

STAGE CIRCUIT AND SCAN DRIVER USING THE SAME

CROSS-REFERENCE TO RELATED APPLICATION

This application claims priority to Korean patent application number 10-2017-0090404, filed on Jul. 17, 2017, in the Korean Intellectual Property Office, the disclosure of which is incorporated herein in its entirety by reference.

BACKGROUND

Field of Invention

Aspects of embodiments of the present disclosure relate to a stage circuit and a scan driver including the stage circuit.

Description of Related Art

With the development of information technology, the importance of a display device, which is a connection medium between a user and information, has become ever more apparent. Owing to the importance of the display device, the use of various display devices, such as liquid crystal display (LCD) devices and organic light-emitting display devices, has increased.

Generally, a display device includes a data driver configured to supply data signals to data lines, a scan driver configured to supply scan signals to scan lines, and a display unit including pixels disposed in areas defined by the scan lines and the data lines.

Pixels included in the display unit are selected when scan signals are supplied to the corresponding scan lines, and are supplied with data signals from the associated data lines. The pixels supplied with the data signals emit light having luminance corresponding to the data signals.

The scan driver includes stage circuits coupled to the respective scan lines. Each stage circuit is configured to supply a scan signal to the corresponding scan line coupled thereto in response to signals supplied from a timing controller.

Pixels included in an organic light-emitting display device may include an N-type transistor (e.g., an NMOS transistor) and/or a P-type transistor (e.g., a PMOS transistor) so as to reduce or minimize leakage current.

SUMMARY

Aspects of embodiments of the present invention are directed to a pixel utilizing a stage circuit formed of P-type transistors and configured to supply a high-level scan signal and/or to utilize a stage circuit formed of N-type transistors and configured to supply a low-level scan signal.

According to embodiments of the present disclosure, there is provided a stage circuit including: an output circuit configured to supply, to a first output terminal, a first clock signal supplied to a second input terminal or to supply a voltage of a second power source supplied to a second power input terminal, in response to voltages of a first node and a second node; an input circuit coupled to the second power input terminal and configured to control voltages of a third node and a fourth node in response to a shift pulse or a gate start pulse supplied to a first input terminal, a third clock signal supplied to a third input terminal, and a fourth clock signal supplied to a fourth input terminal; a first driver coupled to both a first power input terminal and the second power input terminal, the first power input terminal being configured to receive a voltage of a first power source, the first driver being configured to control the voltages of the first node and the second node in response to both the third clock signal and the voltages of the third node and the fourth node; a second driver coupled to the first power input terminal and configured to supply the voltage of the first power source to the fourth node in response to both the fourth clock signal and the voltage of the second node; and a third driver configured to control the voltage of the second node in response to both the fourth clock signal and the voltage of the second node.

In some embodiments, the stage circuit further includes a second output terminal coupled to the fourth node and configured to supply the voltage of the fourth node as a shift pulse to a subsequent stage circuit.

In some embodiments, the output circuit includes: a first transistor coupled between the second input terminal and the first output terminal, and including a gate electrode coupled to the first node; a second transistor coupled between the first output terminal and the second power input terminal, and including a gate electrode coupled to the second node; and a first capacitor coupled between the second input terminal and the first node.

In some embodiments, the first capacitor is a parasitic capacitor of the first transistor or a separate external capacitor.

In some embodiments, the input circuit includes: a third transistor and a fourth transistor coupled in series between the first input terminal and the third node; a fifth transistor coupled between the fourth node and the fourth input terminal, and including a gate electrode coupled to the third node; and a second capacitor coupled between the third node and the fourth node, and wherein the third transistor includes a gate electrode coupled to the third input terminal, and the fourth transistor includes a gate electrode coupled to the second power input terminal.

In some embodiments, the first driver includes: a sixth transistor coupled between the first power input terminal and the first node, and including a gate electrode coupled to the second node; a seventh transistor coupled between the first node and the second power input terminal, and including a gate electrode coupled to the third node; an eighth transistor coupled between the first power input terminal and the second node, and including a gate electrode coupled to the fourth node; and a ninth transistor coupled between the second node and the second power input terminal, and including a gate electrode coupled to the third input terminal.

In some embodiments, the first driver includes: a sixth transistor coupled between the first power input terminal and the first node, and including a gate electrode coupled to the second node; a seventh transistor coupled between the first node and the second power input terminal, and including a gate electrode coupled to the fourth node; an eighth transistor coupled between the first power input terminal and the second node, and including a gate electrode coupled to the fourth node; and a ninth transistor coupled between the second node and the second power input terminal, and including a gate electrode coupled to the third input terminal.

In some embodiments, the second driver includes: a tenth transistor coupled between the first power input terminal and the fourth node; and an eleventh transistor coupled between a gate electrode of the tenth transistor and the fourth input terminal, and including a gate electrode coupled to the second node.

In some embodiments, the third driver includes: a third capacitor including a first terminal coupled to the second node; and a twelfth transistor coupled between a second electrode of the third capacitor and the fourth input terminal, and including a gate electrode coupled to the second node.

In some embodiments, the output circuit, the input circuit, the first driver, the second driver, and the third driver include P-type transistors, and the first power source is set to a voltage higher than that of the second power source.

In some embodiments, the output circuit, the input circuit, the first driver, the second driver, and the third driver include N-type transistors, and the first power source is set to a voltage lower than that of the second power source.

According to embodiments of the present disclosure, there is provided a scan driver including stage circuits coupled to respective scan lines, an i-th (i being a natural number) stage circuit including: an output circuit configured to supply, to a first output terminal, a first clock signal supplied to a second input terminal or to supply a voltage of a second power source supplied to a second power input terminal, in response to voltages of a first node and a second node; an input circuit coupled to the second power input terminal and configured to control voltages of a third node and a fourth node in response to a shift pulse or a gate start pulse supplied to a first input terminal, a third clock signal supplied to a third input terminal, and a fourth clock signal supplied to a fourth input terminal; a first driver coupled to both a first power input terminal and the second power input terminal, the first power input terminal being configured to receive a voltage of a first power source, the first driver being configured to control the voltages of the first node and the second node in response to both the third clock signal and the voltages of the third node and the fourth node; a second driver coupled to the first power input terminal and configured to supply the voltage of the first power source to the fourth node in response to both the fourth clock signal and the voltage of the second node; and a third driver configured to control the voltage of the second node in response to both the fourth clock signal and the voltage of the second node.

In some embodiments, when the i-th stage circuit is a first stage circuit, wherein the gate start pulse is supplied to the first input terminal, and wherein, when the i-th stage circuit is a stage circuit other than the first stage circuit, supply of the shift pulse starts from an i−1-th stage circuit.

In some embodiments, the scan driver further includes a second output terminal coupled to the fourth node and configured to supply the voltage of the fourth node as a shift pulse to an i+1-th stage circuit.

In some embodiments, a second clock signal is supplied to a second input terminal of the i+1-th stage circuit, the fourth clock signal is supplied to a third input terminal of the i+1-th stage circuit, and the third clock signal is supplied to a fourth input terminal of the i+1-th stage circuit.

In some embodiments, the first clock signal and the second clock signal have an identical cycle, and the second clock signal has a ½-cycle phase difference relative to the first clock signal.

In some embodiments, a low level period of the third clock signal overlaps a high level period of the second clock signal.

In some embodiments, a low level period of the fourth clock signal overlaps a high level period of the first clock signal.

DETAILED DESCRIPTION

Figure 1:
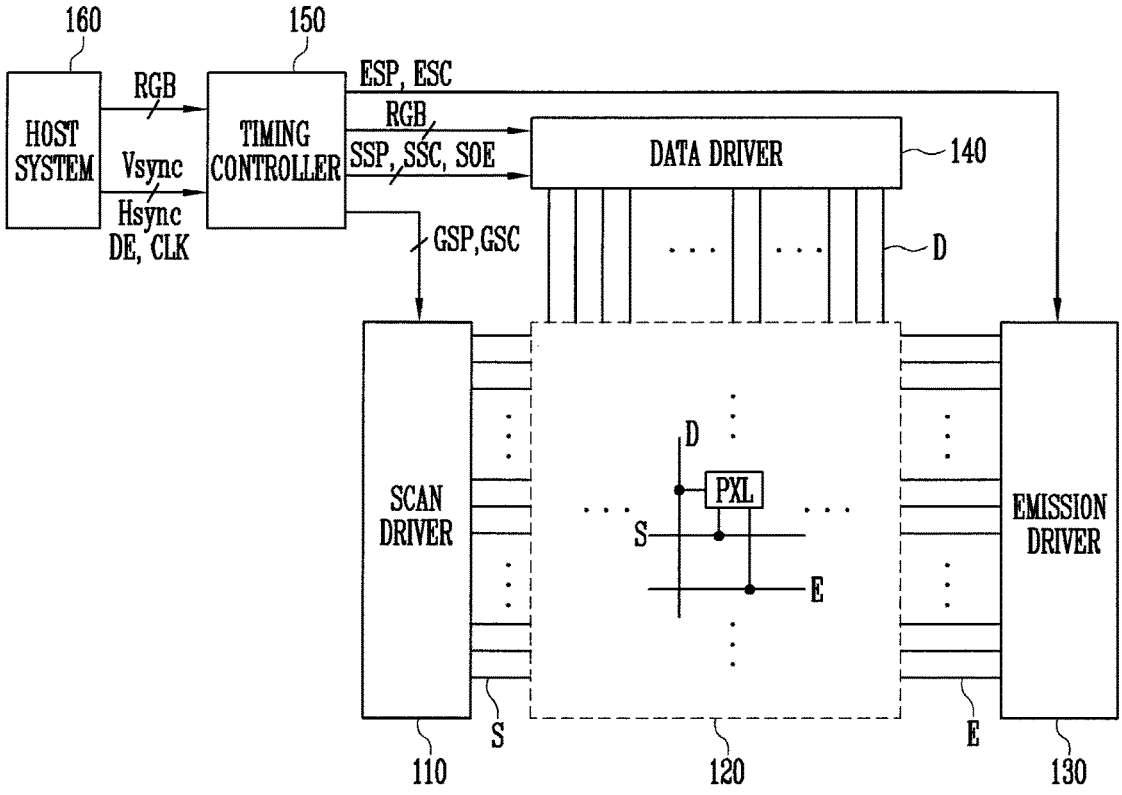
FIG. 1 is a schematic diagram illustrating an organic light-emitting display device in accordance with an embodiment of the present disclosure.

Hereinafter, embodiments will now be described more fully with reference to the accompanying drawings; however, they may be embodied in different forms and should not be construed as limited to the embodiments set forth herein. Rather, these embodiments are provided so that this disclosure will be thorough and complete, and will convey the scope of the embodiments to those skilled in the art.

Reference is now made to the drawings, in which the same reference numerals are used throughout the different drawings to designate the same or similar components.

FIG. 1 is a schematic diagram illustrating an organic light-emitting display device in accordance with an embodiment of the present disclosure.

Referring to FIG. 1, the organic light-emitting display device in accordance with an embodiment of the present disclosure may include a display unit 120, a scan driver 110, an emission driver 130, a data driver 140, a timing controller 150, and a host system 160.

The display unit 120 may include a plurality of pixels PXL which are coupled with data lines D, scan lines S, and emission control lines E. Each of the pixels PXL emits light having a luminance (e.g., a predetermined luminance) in response to a data signal.

The data driver 140 generates a data signal using image data RGB inputted from the timing controller 150. Data signals generated from the data driver 140 are supplied to the data lines D. The data driver 140 may be embodied by various suitable types of well-known circuits.

The scan driver 110 supplies scan signals to the scan lines S. For example, the scan driver 110 may successively (e.g., sequentially) supply scan signals to the scan lines S. Here, the scan signals may be set to a gate-on voltage so that transistors included in the pixels PXL can be turned on. For example, a scan signal supplied from the scan driver 110 may be set to a low level or a high level. The structure of the scan driver 110 will be described in detail later herein.

The emission driver 130 supplies emission control signals to the emission control lines E. For example, the emission driver 130 may successively (e.g., sequentially) supply the emission control signals to the emission control lines E. When the emission control signals are successively supplied, the pixels PXL are successively set to a non-emission state. For this operation, the emission control signals may be set to a gate-off voltage so that transistors included in the pixels PXL can be turned off. The emission driver 130 may be embodied by various suitable types of well-known circuits.

The timing controller 150 may supply a gate control signal to the scan driver 110 and supply a data control signal to the data driver 140, based on timing signals, such as image data RGB, a vertical synchronization signal Vsync, a horizontal synchronization signal Hsync, a data enable signal DE, and a clock signal CLK, outputted from the host system 160. The timing controller 150 supplies an emission control signal to the emission driver 130.

The gate control signal includes a gate start pulse GSP, and one or more gate shift clocks GSC.

The gate start pulse GSP controls a start timing of a scan signal supplied from the scan driver 110. The one or more gate shift clocks GSC refer to one or more clock signals for shifting (e.g., in time) the gate start pulse GSP.

The emission control signal includes an emission start pulse ESP and one or more emission shift clocks ESC. The emission start pulse ESP controls a start timing of an emission control signal. The one or more emission shift clocks ESC refer to one or more clock signals for shifting (e.g., in time) the emission start pulse ESP.

The data control signal includes a source start pulse SSP, a source sampling clock SSC, a source output enable signal SOE, and/or the like. The source start pulse SSP controls a data sampling start timing of the data driver 140. The source sampling clock SSC controls a sampling operation of the data driver 140 based on a rising or falling edge. The source output enable signal SOE controls an output timing of the data driver 140.

The host system 160 supplies image data RGB to the timing controller 150 through an interface (e.g., a predetermined interface). The host system 160 may supply timing signals Vsync, Hsync, DE, and CLK to the timing controller 150.

Figure 2:
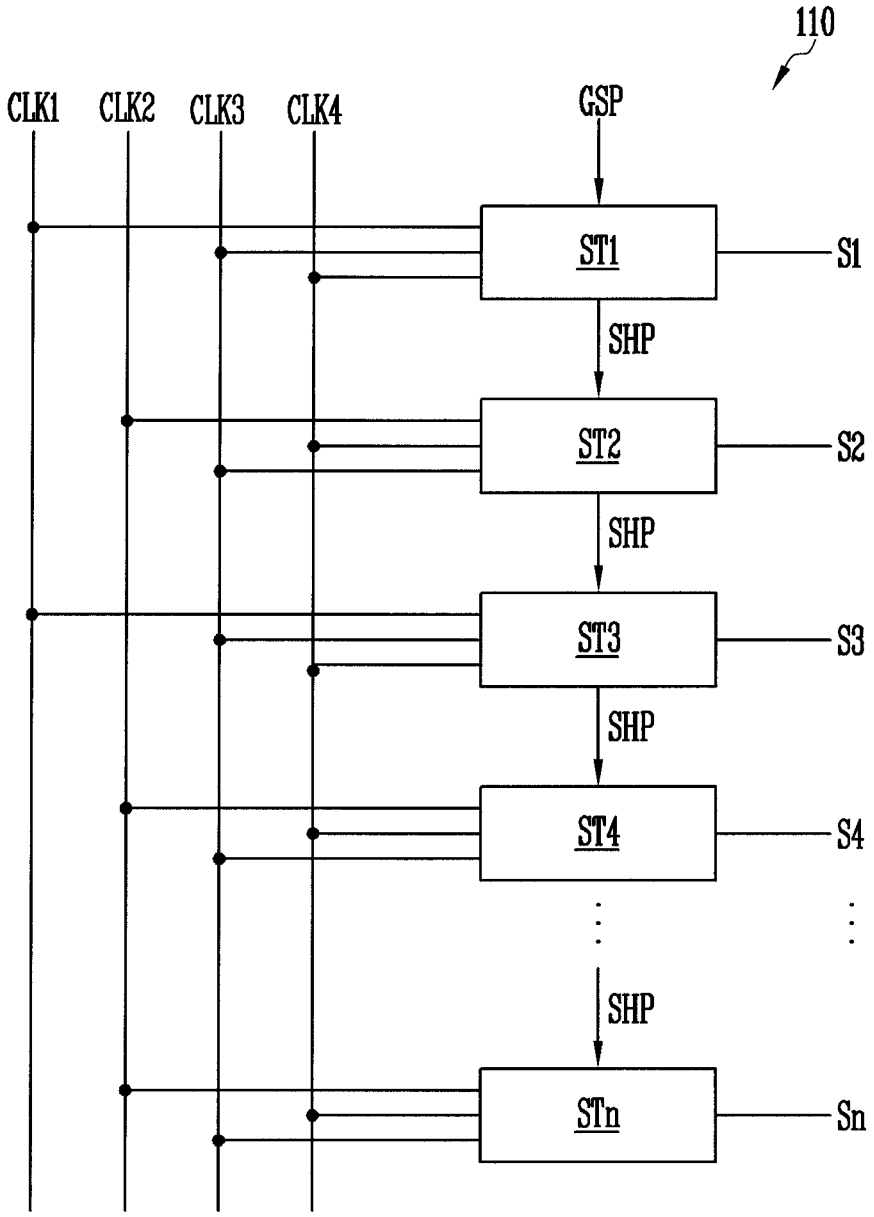
FIG. 2 is a schematic diagram illustrating a scan driver shown in FIG. 1.

FIG. 2 is a schematic diagram illustrating the scan driver 110 shown in FIG. 1. In FIG. 2, there is illustrated an example in which the scan driver 110 includes n (n being a natural number of 2 or more) stage circuits ST.

Referring to FIG. 2, the scan driver 110 in accordance with an embodiment of the present disclosure may include a plurality of stage circuits ST1 to STn. Each of the stage circuits ST1 to STn is coupled to a corresponding one of the scan lines S and is configured to supply a scan signal to the corresponding scan line S in response to a gate start pulse GSP. Here, an i-th (i being a natural number from 1 to n) stage circuit STi may supply a scan signal to an i-th scan line Si.

The first stage circuit ST1 may supply a scan signal to a first scan line S1 in response to the gate start pulse GSP. Each of the other stage circuits ST2 to Stn may supply a scan signal to the corresponding one of the scan lines S2 to Sn that is coupled therewith, in response to a shift pulse SHP supplied from the preceding stage.

Each of the stage circuits ST1 to STn is supplied with three clock signals of four clock signals CLK1 to CLK4 supplied from the scan driver 110.

For example, each of the odd-numbered stage circuits ST1, ST3 . . . may be supplied with the first clock signal CLK1, the third clock signal CLK3, and the fourth clock signal CLK4. Each of the even-numbered stage circuits ST2, ST4 . . . may be supplied with the second clock signal CLK2, the third clock signal CLK3, and the fourth clock signal CLK4. In other words, the first clock signal CLK1 is supplied to the odd-numbered stage circuits ST1, ST3 . . . and the second clock signal CLK2 is supplied to the even-number-th stage circuits ST2, ST4 . . . .

Figure 5:
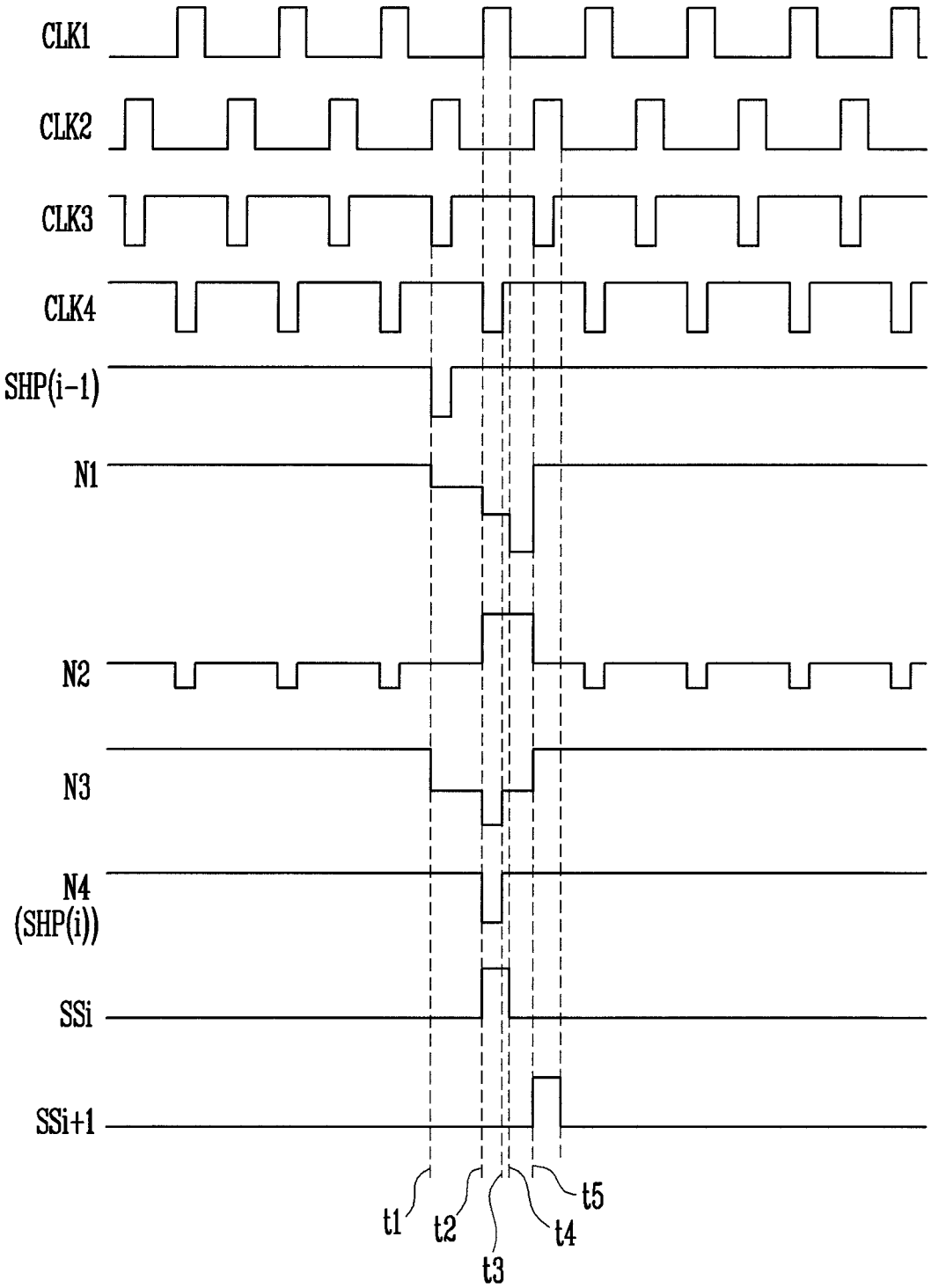
FIG. 5 is a waveform diagram illustrating a process of operating the stage circuit shown in FIG. 4.

As shown in FIG. 5, the first to fourth clock signals CLK1 to CLK4 are square wave signals, each of which alternates between a high level and a low level, and are set to have the same cycle. For instance, the first to fourth clock signals CLK1 to CLK4 may be set to a cycle of two horizontal periods (2H).

The second clock signal CLK2 has the same high level and low level periods as those of the first clock signal CLK1 and is provided with a ½-cycle phase difference relative to the first clock signal CLK1. Here, the low level period may be set to be longer than the high level period.

The low level period of the third clock signal CLK3 overlaps the high level period of the second clock signal CLK2. The high level period of the second clock signal CLK2 may be set to be longer than the low level period of the third clock signal CLK3. The fourth clock signal CLK4 has the same high level and low level periods as those of the third clock signal CLK3 and is provided with a ½-cycle phase difference relative to the third clock signal CLK3. In this case, the low level period of the fourth clock signal CLK4 overlaps the high level period of the first clock signal CLK1.

Figure 3:
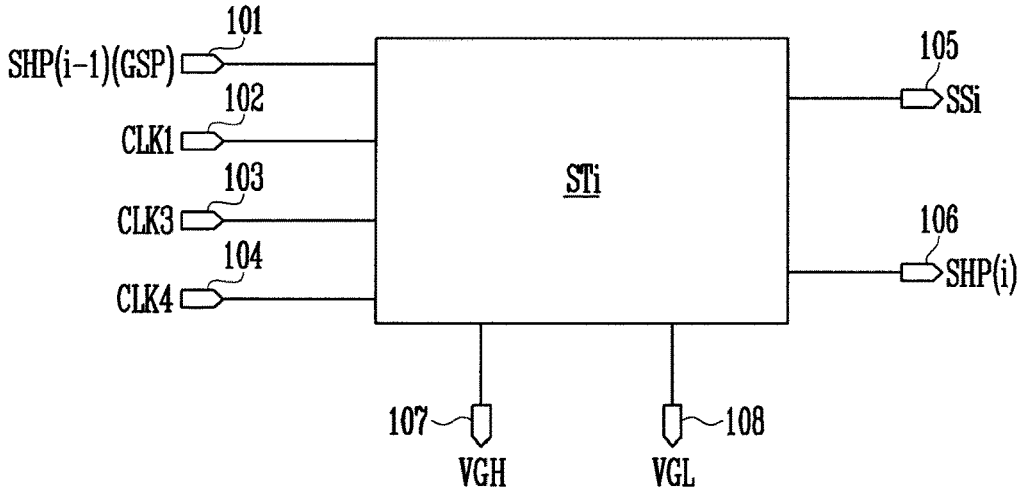
FIG. 3 is a diagram illustrating an embodiment of a connection terminal of a stage circuit shown in FIG. 2.

FIG. 3 is a diagram illustrating an embodiment of a connection terminal of the stage circuit ST shown in FIG. 2. In FIG. 3, for ease of description, the i-th stage circuit STi is illustrated.

Referring to FIG. 3, the stage circuit STi in accordance with an embodiment of the present disclosure may include a first input terminal 101, a second input terminal 102, a third input terminal 103, a fourth input terminal 104, a first output terminal 105, a second output terminal 106, a first power input terminal 107, and a second power input terminal 108.

The first input terminal 101 may receive a shift pulse SHP(i−1) from an i−1-th stage circuit STi−1. Here, when the i-th stage circuit STi is set to the first stage circuit ST1, the first input terminal 101 may receive a gate start pulse GSP.

The second input terminal 102 may receive the first clock signal CLK1. In this case, the second clock signal CLK2 is supplied to the second input terminal 102 of the i−1-th stage circuit STi−1.

In other words, the first clock signal CLK1 is supplied to the second input terminals 102 of the odd-numbered stage circuits ST1, ST3, . . . , and the second clock signal CLK2 is supplied to the second terminals 102 of the even-numbered stage circuits ST2, ST4 . . . .

The third input terminal 103 may receive the third clock signal CLK3. In this case, the fourth clock signal CLK4 is supplied to the third input terminal 103 of the i−1-th stage circuit STi−1.

The fourth input terminal 104 may receive the fourth clock signal CLK4. In this case, the third clock signal CLK3 is supplied to the fourth input terminal 104 of the i−1-th stage circuit STi−1.

In other words, the third clock signal CLK3 is supplied to the third input terminals 103 of the odd-numbered stage circuits ST1, ST3, . . . , and the fourth clock signal CLK4 is supplied to the fourth input terminals 104 thereof. The fourth clock signal CLK4 is supplied to the third input terminals 103 of the even-numbered stage circuits ST2, ST4, . . . , and the third clock signal CLK3 is supplied to the fourth input terminals 104 thereof.

The first output terminal 105 outputs a scan signal SSi of the i-th stage circuit STi. The scan signal SSi outputted from the first output terminal 105 may be supplied to the i-th scan line Si.

The second output terminal 106 outputs a shift pulse SHP(i) of the first stage circuit STi. The shift pulse SHP(i)

outputted from the second output terminal 106 is supplied to the first input terminal 101 of the i+1-th stage circuit STi+1.

The first power input terminal 107 may be coupled to a first power source VGH, and the second power input terminal 108 may be coupled to a second power source VGL. In some examples, depending on a conductivity type (P-type or N-type) of a transistor included in the stage circuit STi, the first power input terminal 107 may be coupled to the second power source VGL, and the second power input terminal 108 may be coupled to the first power source VGH.

The first power source VGH may be set to a voltage higher than that of the second power source VGL. For example, in the case where the stage circuit ST is formed of a P-type transistor, the first power source VGH may be set to a gate-off voltage so that the P-type transistor included in the stage circuit ST is turned off, and the second power source VGL may be set to a gate-on voltage. In the case where the stage circuit ST is formed of an N-type transistor, the first power source VGH may be set to a gate-on voltage so that the N-type transistor included in the stage circuit ST is turned on, and the second power source VGL may be set to a gate-off voltage.

Figure 4:
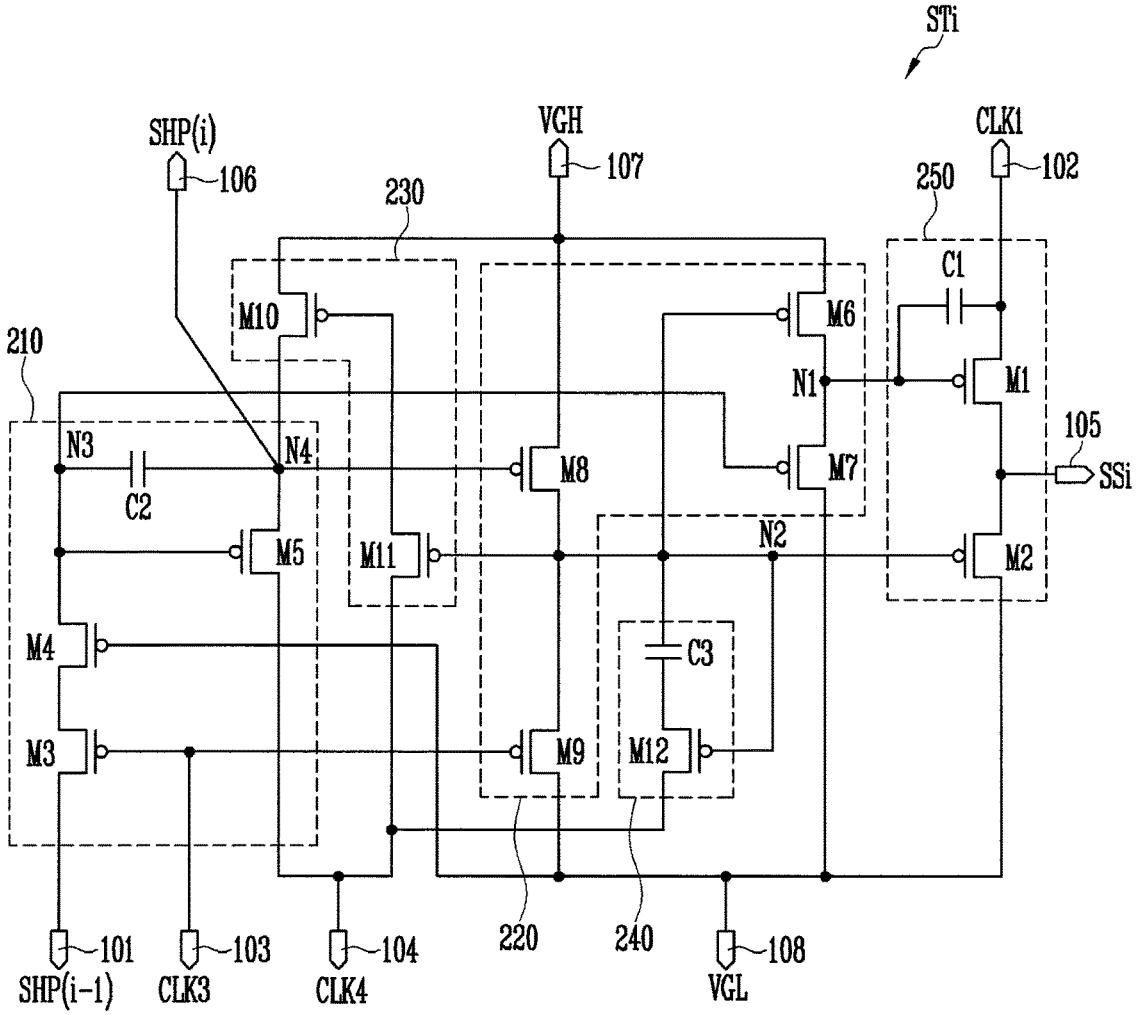
FIG. 4 is a circuit diagram illustrating an embodiment of an i-th stage circuit shown in FIG. 3.

FIG. 4 is a circuit diagram illustrating an embodiment of the i-th stage circuit STi shown in FIG. 3. In FIG. 4, there is illustrated the case where the stage circuit is formed of a P-type transistor. For ease of description, hereinafter, the phrase "setting the first clock signal CLK1 or the second clock signal CLK2 to a high level" refers to supplying said first or second clock signal, and the phrase "setting the third clock signal CLK3 or the fourth clock signal CLK4 to a low level" refers to supplying said third or fourth clock signal. Furthermore, the phrase "setting the gate start pulse GSP or the shift pulse SHP to a low level" refers to supplying said gate start or shift pulse.

Referring to FIG. 4, the stage circuit STi in accordance with an embodiment of the present disclosure may include an input unit (e.g., an input circuit) 210, a first driver 220, a second driver 230, a third driver 240, and an output unit (e.g., an output circuit) 250.

The output unit 250 is coupled to a first node N1, a second node N2, the second input terminal 102, and the second power input terminal 108. The output unit 250 couples the first output terminal 105 to the second input terminal 102 or the second power input terminal 108 in response to the voltages of the first and second nodes N1 and N2. For this operation, the output unit 250 includes a first transistor M1, a second transistor M2, and a first capacitor C1.

A first electrode of the first transistor M1 is coupled to the second input terminal 102, and a second electrode thereof is coupled to the first output terminal 105. A gate electrode of the first transistor M1 is coupled to the first node N1. The first transistor M1 controls the electrical connection between the second input terminal 102 and the first output terminal 105 in response to the voltage of the first node N1.

A first electrode of the second transistor M2 is coupled to the first output terminal 105, and a second electrode thereof is coupled to the second input terminal 108. A gate electrode of the second transistor M2 is coupled to the second node N2. The second transistor M2 controls the electrical connection between the first output terminal 105 and the second power input terminal 108 in response to the voltage of the second node N2.

The first capacitor C1 is coupled between the first node N1 and the second input terminal 102. Here, either an external capacitor or a parasitic capacitor of the first transistor M1 may be selected as the first capacitor C1.

The input unit 210 is coupled to the first input terminal 101, the third input terminal 103, the fourth input terminal 104, and the second power input terminal 108.

The input unit 210 controls the voltages of third and fourth nodes N3 and N4 in response to a shift pulse SHP(i−1) supplied to the first input terminal 101, a third clock signal CLK3 supplied to the third input terminal 103, and a fourth clock signal CLK4 supplied to the fourth input terminal 104. For this operation, the input unit 210 includes a third transistor M3, a fourth transistor M4, a fifth transistor M5, and a second capacitor C2.

The third transistor M3 and the fourth transistor M4 are coupled in series between the first input terminal 101 and the third node N3. A gate electrode of the third transistor M3 is coupled to the third input terminal 103. When the third clock signal CLK3 is supplied (e.g., set to a low level) to the third input terminal 103, the third transistor M3 is turned on so that the fourth transistor M4 and the first input terminal 101 are electrically coupled to each other.

A gate electrode of the fourth transistor M4 is coupled to the second power input terminal 108. In other words, the second power source VGL is supplied to the gate electrode of the fourth transistor M4, whereby the fourth transistor M4 is maintained in a turned-on state. The fourth transistor M4 is used to reduce or minimize a voltage difference between the third node N3 and the third transistor M3. Detailed description related to this will be given with reference to a waveform diagram.

The fifth transistor M5 is coupled between the fourth node N4 and the fourth input terminal 104. A gate electrode of the fifth transistor M5 is coupled to the third node N3. The fifth transistor M5 is turn on or off in response to the voltage of the third node N3, thus controlling the electrical connection between the fourth node N4 and the fourth input terminal 104.

The second capacitor C2 is coupled between the third node N3 and the fourth node N4.

The first driver 220 is coupled to the third input terminal 103, the first power input terminal 107, and the second power input terminal 108. The first driver 220 controls the voltages of the first and second nodes N1 and N2 in response to the voltage of the third node N3, the voltage of the fourth node N4, and the third clock signal CLK3 supplied to the third input terminal 103. For this operation, the first driver 220 includes a sixth transistor M6, a seventh transistor M7, an eighth transistor M8, and a ninth transistor M9.

The sixth transistor M6 is coupled between the first power input terminal 107 and the first node N1. A gate electrode of the sixth transistor M6 is coupled to the second node N2. The sixth transistor M6 controls the electrical connection between the first power input terminal 107 and the first node N1 in response to the voltage of the second node N2.

The seventh transistor M7 is coupled between the first node N1 and the second power input terminal 108. A gate electrode of the seventh transistor M7 is coupled to the third node N3. The seventh transistor M7 controls the electrical connection between the first node N1 and the second power input terminal 108 in response to the voltage of the third node N3.

The eighth transistor M8 is coupled between the first power input terminal 107 and the second node N2. A gate electrode of the eighth transistor M8 may be coupled to the fourth node N4. The eighth transistor M8 controls the electrical connection between the first power input terminal 107 and the second node N2 in response to the voltage of the fourth node N4.

The ninth transistor M9 is coupled between the second node N2 and the second power input terminal 108. A gate electrode of the ninth transistor M9 is coupled to the third input terminal 103. When the third clock signal CLK3 is supplied to the third input terminal 103, the ninth transistor M9 is turned on to supply the voltage of the second power source VGL to the second node N2.

The second driver 230 is coupled to the first power input terminal 107 and the fourth input terminal 104. The second driver 230 supplies the voltage of the first power source VGH to the fourth node N4 in response to both the fourth clock signal CLK4 supplied to the fourth input terminal 104 and to the voltage of the second node N2. In this case, the fourth node N4 may repeatedly receive the voltage of the first power source VGH, so that the driving stability of the stage circuit can be secured or improved. For this, the second driver 230 includes a tenth transistor M10 and an eleventh transistor M11.

The tenth transistor M10 is coupled between the first power input terminal 107 and the fourth node N4. A gate electrode of the tenth transistor M10 is coupled to a first electrode of the eleventh transistor M11. When the fourth clock signal CLK4 is supplied to the tenth transistor M10 via the eleventh transistor M11, the tenth transistor M10 is turned on to supply the voltage of the first power source VGH to the fourth node N4.

The eleventh transistor M11 is coupled between the gate electrode of the tenth transistor M10 and the fourth input terminal 104. A gate electrode of the eleventh transistor M11 is coupled to the second node N2. The eleventh transistor M11 controls the electrical connection between the gate electrode of the tenth transistor M10 and the fourth input terminal 104 in response to the voltage of the second node N2.

The third driver 240 is coupled to the fourth input terminal 104. The third driver 240 periodically reduces the voltage of the second node N2 in response to both the fourth clock signal CLK4 supplied to the fourth input terminal 104 and to the voltage of the second node N2. For this, the third driver 240 includes a twelfth transistor M12 and a third capacitor C3.

The twelfth transistor M12 is coupled between the third capacitor C3 and the fourth input terminal 104. A gate electrode of the twelfth transistor M12 is coupled to the second node N2. The twelfth transistor M12 controls the electrical connection between the third capacitor C3 and the fourth input terminal 104 in response to the voltage of the second node N2.

The third capacitor C3 is coupled between the twelfth transistor M12 and the second node N2. The third capacitor C3 controls the voltage of the second node N2 in response to the fourth clock signal CLK4 supplied to the third capacitor C3 via the twelfth transistor M12.

In an embodiment of the present disclosure, the second output terminal 106 may be coupled to the fourth node N4. In other words, the voltage of the fourth node N4 is supplied as a shift pulse SHP(i) to a subsequent stage circuit STi+1.

FIG. 5 is a waveform diagram illustrating a process of operating the stage circuit STi shown in FIG. 4.

Referring to FIG. 5, the shift pulse SHP(i−1) is supplied to the first input terminal 101 at a first time t1. Here, the shift pulse SHP(i−1) is supplied in synchronization with (e.g., supplied simultaneously or concurrently with) a clock signal that is supplied to the third input terminal 103, that is, in synchronization with (e.g., supplied simultaneously or concurrently with) the third clock signal CLK3. When the third clock signal CLK3 is supplied to the third input terminal 103, the third transistor M3 and the ninth transistor M9 are turned on.

When the ninth transistor M9 is turned on, the voltage of the second power source VGL is supplied to the second node N2. When the voltage of the second power source VGL is supplied to the second node N2, the second transistor M2 and the sixth transistor M6 are turned on.

If the second transistor M2 is turned on, the first output terminal 105 and the second power input terminal 108 are electrically connected to each other, so that the voltage of the second power source VGL is supplied to the first output terminal 105.

When the third transistor M3 is turned on, the shift pulse SHP(i−1) supplied to the first input terminal 101 is supplied to the third node N3 via the fourth transistor M4. When the shift pulse SHP(i−1) is supplied to the third node N3, the voltage of the third node N3 is reduced to a low voltage, whereby the seventh transistor M7 is turned on.

Here, because the sixth transistor M6 and the seventh transistor M7 are set to the turned-on state, the voltage of the first node N1 is reduced to a voltage between the first power source VGH and the second power source VGL. In other words, the sixth transistor M6 and the seventh transistor M7 that have been set to the turned-on state may be equivalently replaced with resistances, and, in this case, the first node N1 may be set to a voltage between the first power source VGH and the second power source VGL. For example, when the first power source VGH is set to about 6 V and the second power source VGL is set to about −6 V, the voltage of the first node N1 may be set to approximately 0 V.

At the first time t1, the second input terminal 102 and the first output terminal 105 are set to a low voltage (e.g., set to the voltage of the second power source VGL). Hence, even when the voltage of the first node N1 is reduced, the first transistor M1 is maintained in the turned-off state.

In addition, the voltage of the first node N1 may be controlled in various suitable ways depending on the intention of a designer. For instance, when the capacitance of the third capacitor C3 is increased, the time it takes to reduce the voltage of the second node N2 is increased. In this case, the sixth transistor M6 may be maintained in the turned-off state for a period (e.g., a predetermined period), and in response to this, the voltage of the first node N1 may be controlled.

In the case where a channel width to channel length (W/L) ratio of the ninth transistor M9 is set to a value less than a W/L ratio of the eighth transistor M8, the time it takes to reduce the voltage of the second node N2 is increased. In this case, the sixth transistor M6 may be maintained in the turned-off state for a period (e.g., a predetermined period), and in response to this, the voltage of the first node N1 may be controlled.

When the voltage of the third node N3 is reduced to a low voltage, the fifth transistor M5 is turned on. When the fifth transistor M5 is turned on, the fourth node N4 and the fourth input terminal 104 are electrically coupled to each other. Here, because the fourth clock signal CLK4 is not supplied to the fourth input terminal 104, the fourth input terminal 104 is set to a high voltage, so that the eighth transistor M8 is maintained in a turned-off state.

At a second time t2, the first clock signal CLK1 is supplied to the second input terminal 102, and the fourth clock signal CLK4 is supplied to the fourth input terminal 104.

If the fourth clock signal CLK4 is supplied to the fourth input terminal 104, the voltage of the fourth node N4 is reduced to a low voltage. When the voltage of the fourth node N4 is reduced to the low voltage, the eighth transistor M8 is turned on. When the eighth transistor M8 is turned on, the voltage of the first power source VGH is supplied to the second node N2. Hence, the sixth transistor M6 and the second transistor M2 are turned off.

When the voltage of the fourth node N4 is reduced to the low voltage, the voltage of the third node N3 is further reduced by coupling of the second capacitor C2. For example, the voltage of the third node N3 may be reduced to a voltage lower than that of the second power source VGL. When the voltage of the third node N3 is reduced, the seventh transistor M7 is completely turned on. Supplied to the fourth node N4, the voltage of the fourth clock signal CLK4 is supplied as a shift pulse SHP(i) to a subsequent stage circuit STi+1 via the second output terminal 102.

When the seventh transistor M7 is turned on, the voltage of the first node N1 is reduced to the voltage of the second power source VGL. When the voltage of the first node N1 is reduced to the voltage of the second power source VGL, the first transistor M1 is turned on. When the first transistor M1 is turned on, the second input terminal 102 and the first output terminal 105 are electrically coupled to each other.

Then, the first clock signal CLK1 supplied to the second input terminal 102 is supplied to the first output terminal 105. The first clock signal CLK1 supplied to the first output terminal 105 is supplied to a scan line as a scan signal SSi.

As described above, in an embodiment of the present disclosure, a high-level scan signal SSi may be supplied using P-type transistors. Furthermore, when the voltage of the third node N3 is reduced to a voltage lower than that of the second power source VGL, the characteristics of the seventh transistor M7 may be stably maintained, whereby the driving stability of the stage circuit may be secured or improved.

When the voltage of the third node N3 is further reduced by the coupling of the second capacitor C2, the voltage of the first electrode of the third transistor M3 is not reduced to a voltage lower than that of the second power source VGL by the fourth transistor M4. Hence, when the voltage of the third node N3 is reduced, the voltage of the fourth transistor M4 is set to approximately a voltage difference between the third node N3 and the second power source VGL. Thus, an operational malfunction attributable to a high voltage difference may be prevented or instances thereof may be reduced. Likewise, because the voltage of the third transistor M3 is also set to a voltage between the second power source VGL and the first input terminal 101, an operational malfunction attributable to a high voltage difference may be prevented or instances thereof may be reduced.

At a third time t3, the supply of the fourth clock signal CLK4 is interrupted (e.g., stopped). When the supply of the fourth clock signal CLK4 is interrupted (e.g., stopped), the voltage of the fourth input terminal 104 is increased to a high voltage, so that the voltage of the fourth node N4 is set to a high voltage.

When the voltage of the fourth node N4 is set to the high voltage, the eighth transistor M8 is turned off. Here, the voltage of the second node N2 is maintained at the voltage of the preceding period by the third capacitor C3, etc. When the voltage of the fourth node N4 is set to the high voltage, the voltage of the third node N3 is increased by coupling of the second capacitor C2.

At a fourth time t4, the supply of the first clock signal CLK1 is interrupted (e.g., stopped). When the supply of the first clock signal CLK1 is interrupted (e.g., stopped), the voltage of the second input terminal 102 is reduced from the high voltage to the low voltage. Then, a low voltage is supplied to the first output terminal 105, whereby the supply of the scan signal SSi is interrupted (e.g., stopped).

If the voltage of the second input terminal 102 is reduced from the high voltage to the low voltage, the voltage of the first node N1 is reduced by coupling of the first capacitor C1. When the voltage of the first node N1 is reduced, the first transistor M1 is maintained in the turned-on state, whereby a low voltage is supplied to the first output terminal 105.

At a fifth time t5, the third clock signal CLK3 is supplied to the third input terminal 103. When the third clock signal CLK3 is supplied to the third input terminal 103, the third transistor M3 and the ninth transistor M9 are turned on.

When the ninth transistor M9 is turned on, the voltage of the second power source VGL is supplied to the second node N2. When the voltage of the second power source VGL is supplied to the second node N2, the second transistor M2 and the sixth transistor M6 are turned on.

If the second transistor M2 is turned on, the first output terminal 105 and the second power input terminal 108 are electrically connected to each other, so that the voltage of the second power source VGL is supplied to the first output terminal 105.

If the sixth transistor M6 is turned on, the voltage of the first power source VGH is supplied to the first node N1. Hence, the first transistor M1 is turned off.

When the third transistor M3 is turned on, the high voltage of the first input terminal 101 is supplied to the third node N3. When the high voltage is supplied to the third node N3, the seventh transistor M7 is set to the turned-off state. Then, after the fifth time t5, the first transistor M1 is set to the turned-off state, and the second transistor M2 is set to the turned-on state. Consequently, the first output terminal 105 is reliably maintained at the voltage of the second power source VGL.

When the voltage of the second node N2 is set to a low voltage, the eleventh transistor M11 is turned on. When the eleventh transistor M11 is turned on, the fourth input terminal 104 and the gate electrode of the tenth transistor M10 are electrically coupled to each other.

Then, the tenth transistor M10 is turned on each time the fourth clock signal CLK4 is supplied to the fourth input terminal 104. When the tenth transistor M10 is turned on, the voltage of the first power source VGH is supplied to the fourth node N4. In other words, in an embodiment of the present disclosure, the fourth node N4 may be periodically supplied with the voltage of the first power source VGH. Hence, a ripple (e.g., a voltage ripple) is prevented or substantially prevented from being generated on the fourth node N4, whereby the driving stability of the stage circuit may be secured or improved.

When the voltage of the second node N2 is set to the low voltage, the twelfth transistor M12 is turned on. When the twelfth transistor M12 is turned on, the third capacitor C3 is electrically coupled to the fourth input terminal 104. Then, the voltage of the second node N2 is reduced by coupling of the third capacitor C3 when the fourth clock signal CLK4 is supplied to the fourth input terminal 104. Thereby, the second transistor M2 may be reliably set to the turned-on state.

The shift pulse SHP(i) supplied to the second output terminal 106 is supplied to the i+1-th stage circuit STi+1 in synchronization with (e.g., supplied simultaneously or concurrently with) the fourth clock signal CLK4. The i+1-th stage circuit STi+1 supplied with the shift pulse SHP(i) supplies a scan signal SSi+1 to the output terminal 105 in response to the fourth clock signal CLK4 supplied to the third input terminal 103. In other words, the stage circuits ST in accordance with an embodiment of the present disclosure repeatedly performs the above-described process to supply scan signals SS to the scan lines S.

Figure 6:
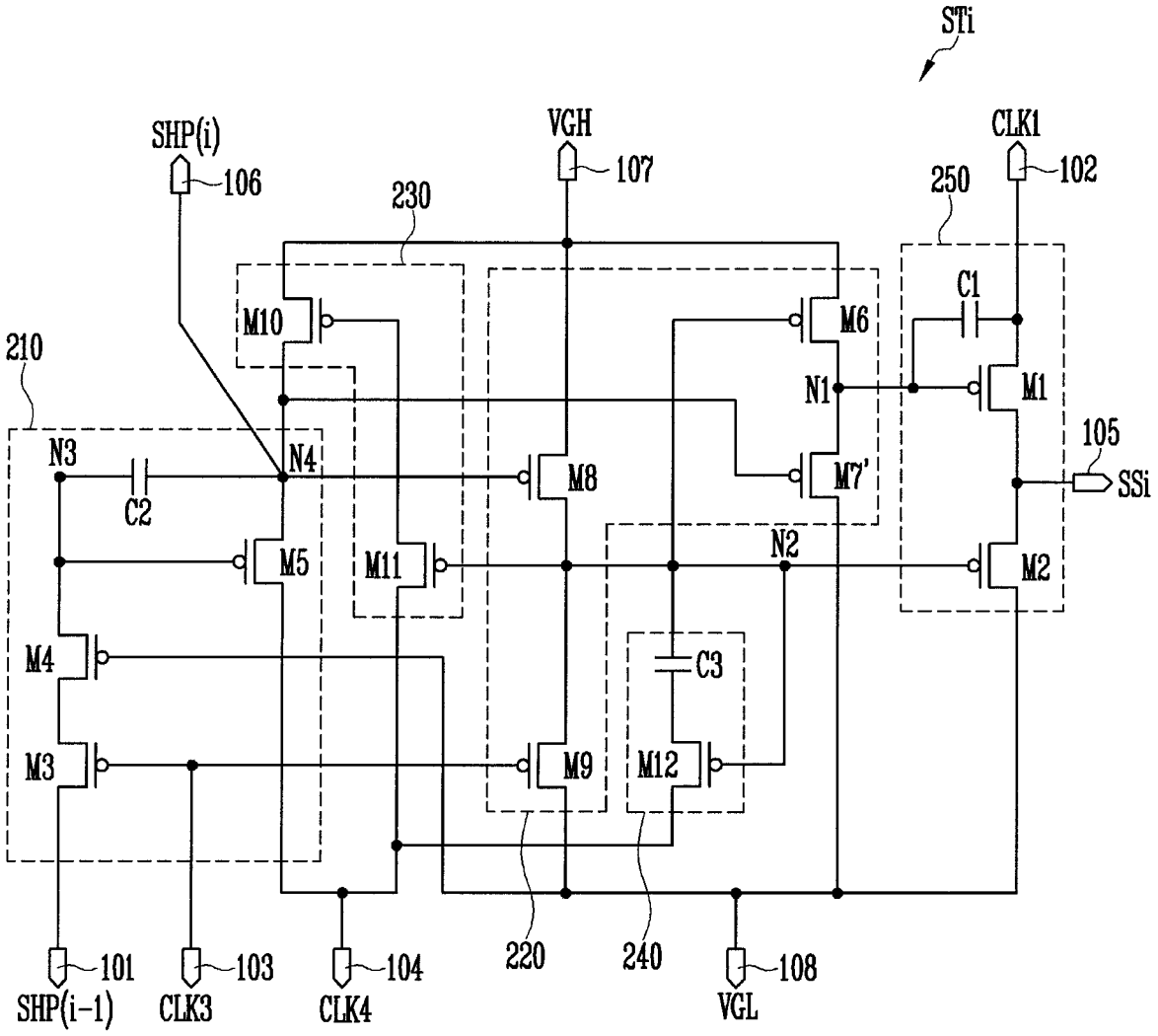
FIG. 6 is a circuit diagram illustrating an embodiment of the i-th stage circuit shown in FIG. 3.

FIG. 6 is a circuit diagram illustrating an embodiment of the i-th stage circuit STi shown in FIG. 3. In the following description of FIG. 6, the same reference numerals will be used to designate the same components as those of FIG. 4, and detailed explanation thereof may not be repeated.

Referring to FIG. 6, a gate electrode of a seventh transistor M7' is coupled to the fourth node N4. The seventh transistor M7' is turned on or off in response to the voltage of the fourth node N4.

If the seventh transistor M7' is turned on, the voltage of the second power source VGL is supplied to the first node N1. Hence, the first transistor M1 is turned on. When the first transistor M1 is turned on, the first clock signal CLK1 supplied to the second input terminal 102 is supplied to the first output terminal 105. The first clock signal CLK1 supplied to the first output terminal 105 is supplied to a scan line Si as a scan signal SSi.

The stage circuit STi in accordance with this embodiment of the present disclosure is operated in the substantially same manner as that of the embodiment of FIG. 4; therefore, detailed description thereof may not be repeated.

Figure 7:
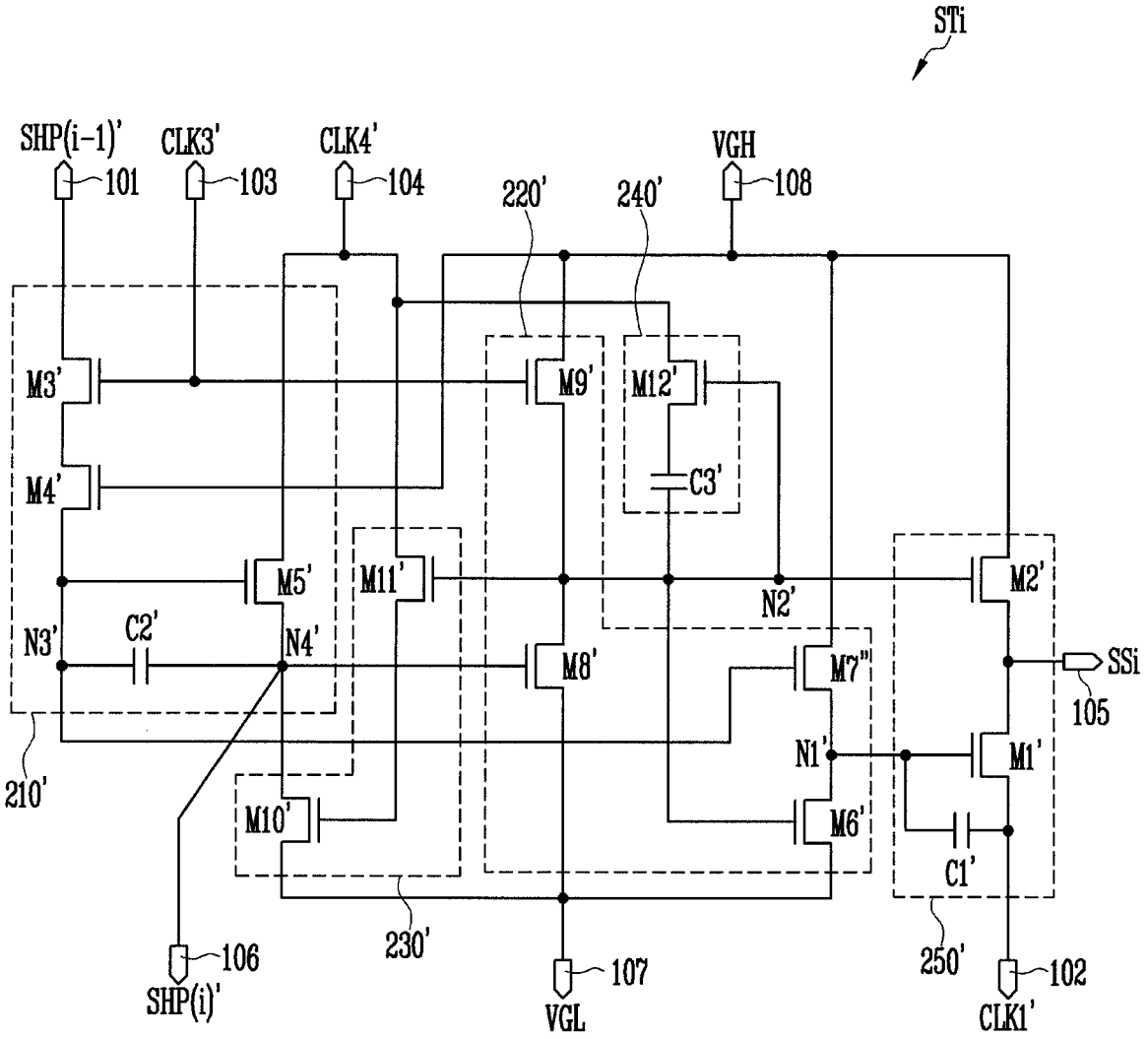
FIG. 7 is a circuit diagram illustrating an embodiment of the i-th stage circuit shown in FIG. 3.
Figure 8:
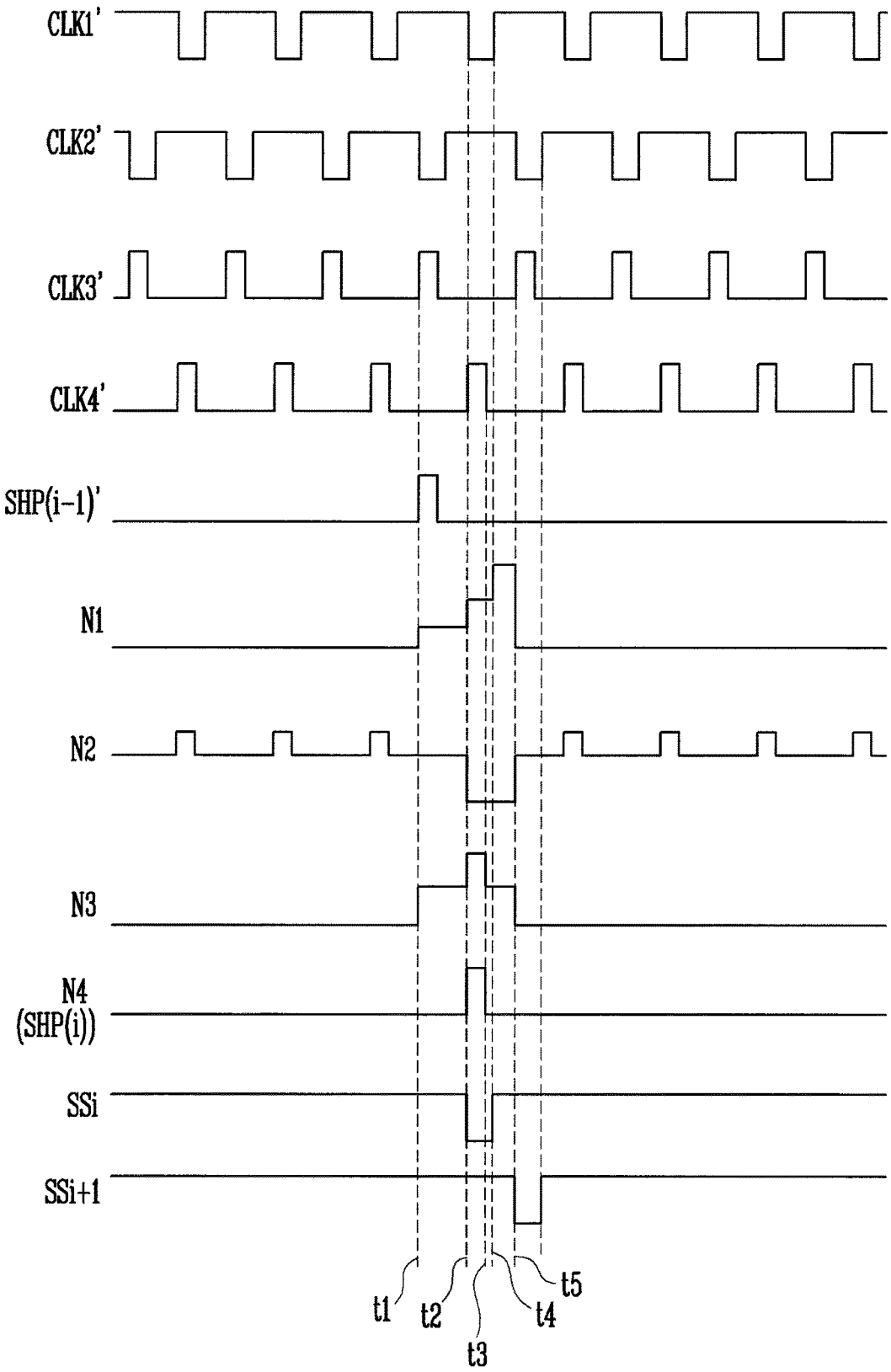
FIG. 8 is a waveform diagram illustrating a process of operating the stage circuit shown in FIG. 7.

FIG. 7 is a circuit diagram illustrating an embodiment of the i-th stage circuit STi shown in FIG. 3. In FIG. 7, there is illustrated the case where the stage circuit STi is formed of an N-type transistor. The stage circuit STi according to this embodiment may be formed by replacing the P-type transistor of FIG. 4 with the N-type transistor. In this case, as shown in FIG. 8, clock signals CLK1' to CLK4' are set by inverting the clock signals CLK1 to CLK4 of FIG. 5.

For ease of description, hereinafter, the phrase "setting the first clock signal CLK1' or the second clock signal CLK2' to a low level" refers to supplying said first or second clock signal, and the phrase "setting the third clock signal CLK3' or the fourth clock signal CLK4' to a high level" refers to supplying said third or fourth clock signal. Furthermore, the phrase "setting a shift pulse SHP' to a high level" refers to supplying said shift pulse.

Referring to FIG. 7, the stage circuit STi in accordance with an embodiment of the present disclosure may include an input unit (e.g., an input circuit) 210', a first driver 220', a second driver 230', a third driver 240', and an output unit (e.g., an output circuit) 250'.

The output unit 250' is coupled to a first node N1', a second node N2', the second input terminal 102, and the second power input terminal 108. The output unit 250' couples the first output terminal 105 to the second input terminal 102 or the second power input terminal 108 in response to the voltages of the first and second nodes N1' and N2'. For this operation, the output unit 250' includes a first transistor M1', a second transistor M2', and a first capacitor C1'.

A first electrode of the first transistor M1' is coupled to the second input terminal 102, and a second electrode thereof is coupled to the first output terminal 105. A gate electrode of the first transistor M1' may be coupled to a first node N1'. The first transistor M1' controls the electrical connection between the second input terminal 102 and the first output terminal 105 in response to the voltage of the first node N1'.

A first electrode of the second transistor M2' is coupled to the first output terminal 105, and a second electrode thereof is coupled to the second input terminal 108. A gate electrode of the second transistor M2' is coupled to the second node N2'. The second transistor M2' controls the electrical connection between the first output terminal 105 and the second power input terminal 108 in response to the voltage of the second node N2'.

The first capacitor C1' is coupled between the first node N1' and the second input terminal 102. The first capacitor C1' stores a voltage (e.g., a predetermined voltage) in response to turning on or off the first transistor M1'. Here, either an external capacitor or a parasitic capacitor of the first transistor M1' may be selected as the first capacitor C1'.

The input unit 210' is coupled to the first input terminal 101, the third input terminal 103, the fourth input terminal 104, and the second power input terminal 108. The input unit 201' controls the voltages of the third and fourth nodes N3' and N4' in response to a shift pulse SHP(i−1)' supplied to the first input terminal 101, a third clock signal CLK3' supplied to the third input terminal 103, and a fourth clock signal CLK4' supplied to the fourth input terminal 104. For this operation, the input unit 210' includes a third transistor M3', a fourth transistor M4', a fifth transistor M5', and a second capacitor C2'.

The third transistor M3' and the fourth transistor M4' are coupled in series between the first input terminal 101 and the third node N3'. A gate electrode of the third transistor M3' is coupled to the third input terminal 103. When the third clock signal CLK3' is supplied (e.g., set to a high level) to the third input terminal 103, the third transistor M3' is turned on so that the fourth transistor M4' and the first input terminal 101 are electrically coupled to each other.

A gate electrode of the fourth transistor M4' is coupled to the second power input terminal 108. In other words, the first power source VGH is supplied to the gate electrode of the fourth transistor M4', whereby the fourth transistor M4' is maintained in a turned-on state. The fourth transistor M4' may reduce or minimize a voltage difference between the third node N3' and the third transistor M3'.

The fifth transistor M5' is coupled between the fourth node N4' and the fourth input terminal 104. A gate electrode of the fifth transistor M5' is coupled to the third node N3'. The fifth transistor M5' is turn on or off in response to the voltage of the third node N3', thus controlling the electrical connection between the fourth node N4' and the fourth input terminal 104.

The second capacitor C2' is coupled between the third node N3' and the fourth node N4'.

The first driver 220' is coupled to the third input terminal 103, the first power input terminal 107, and the second power input terminal 108. The first driver 220' controls the voltages of the first and second nodes N1' and N2' in response to the voltage of the third node N3', the voltage of the fourth node N4', and the third clock signal CLK3' supplied to the third input terminal 103. For this operation, the first driver 220' includes a sixth transistor M6', a seventh transistor M7", an eighth transistor M8', and a ninth transistor M9'.

The sixth transistor M6' is coupled between the first power input terminal 107 and the first node N1'. A gate electrode of the sixth transistor M6' is coupled to the second node N2'. The sixth transistor M6' controls the electrical connection between the first power input terminal 107 and the first node N1' in response to the voltage of the second node N2'.

The seventh transistor M7" is coupled between the first node N1' and the second power input terminal 108. A gate electrode of the seventh transistor M7" is coupled to the third node N3'. The seventh transistor M7" controls the electrical connection between the first node N1' and the second power input terminal 108 in response to the voltage of the third node N3'.

The eighth transistor M8' is coupled between the first power input terminal 107 and the second node N2'. A gate electrode of the eighth transistor M8' may be coupled to the fourth node N4'. The eighth transistor M8' controls the electrical connection between the first power input terminal 107 and the second node N2' in response to the voltage of the fourth node N4'.

The ninth transistor M9' is coupled between the second node N2' and the second power input terminal 108. A gate electrode of the ninth transistor M9' is coupled to the third input terminal 103. When the third clock signal CLK3' is supplied to the third input terminal 103, the ninth transistor M9' is turned on to supply the voltage of the first power source VGH to the second node N2'.

The second driver 230' is coupled to the first power input terminal 107 and the fourth input terminal 104. The second driver 230' supplies the voltage of the second power source VGL to the fourth node N4' in response to both the fourth clock signal CLK4' supplied to the fourth input terminal 104 and to the voltage of the second node N2'. In this case, the fourth node N4' may repeatedly receive the voltage of the second power source VGL, so that the driving stability of the stage circuit can be secured or improved. For this, the second driver 230' includes a tenth transistor M10' and an eleventh transistor M11'.

The tenth transistor M10' is coupled between the first power input terminal 107 and the fourth node N4'. A gate electrode of the tenth transistor M10' is coupled to a first electrode of the eleventh transistor M11'. When the fourth clock signal CLK4' is supplied to the tenth transistor M10' via the eleventh transistor M11', the tenth transistor M10' is turned on to supply the voltage of the second power source VGL to the fourth node N4'.

The eleventh transistor M11' is coupled between the gate electrode of the tenth transistor M10' and the fourth input terminal 104. A gate electrode of the eleventh transistor M11' is coupled to the second node N2'. The eleventh transistor M11' controls the electrical connection between the gate electrode of the tenth transistor M10' and the fourth input terminal 104' in response to the voltage of the second node N2'.

The third driver 240' is coupled to the fourth input terminal 104. The third driver 240' periodically increases the voltage of the second node N2' in response to both the fourth clock signal CLK4' supplied to the fourth input terminal 104 and to the voltage of the second node N2'. Hence, the driving stability of the stage circuit may be secured or improved. For this, the third driver 240' includes a twelfth transistor M12' and a third capacitor C3'.

The twelfth transistor M12' is coupled between the third capacitor C3' and the fourth input terminal 104. A gate electrode of the twelfth transistor M12' is coupled to the second node N2'. The twelfth transistor M12' controls the electrical connection between the third capacitor C3' and the fourth input terminal 104 in response to the voltage of the second node N2'.

The third capacitor C3' is coupled between the twelfth transistor M12' and the second node N2'. The third capacitor C3' controls the voltage of the second node N2' in response to the fourth clock signal CLK4' supplied to the third capacitor C3' via the twelfth transistor M12'.

In an embodiment of the present disclosure, the second output terminal 106 may be coupled to the fourth node N4'. In other words, the voltage of the fourth node N4' is supplied as a shift pulse SHP(i)' to a subsequent stage circuit STi+1.

FIG. 8 is a waveform diagram illustrating a process of operating the stage circuit STi shown in FIG. 7.

Referring to FIG. 8, a shift pulse SHP(i−1)' is supplied to the first input terminal 101 at a first time t1. Here, the shift pulse SHP(i−1)' is supplied in synchronization with (e.g., supplied simultaneously or concurrently with) a clock signal that is supplied to the third input terminal 103, that is, in synchronization with (e.g., simultaneously or concurrently with) the third clock signal CLK3'. When the third clock signal CLK3' is supplied to the third input terminal 103, the third transistor M3' and the ninth transistor M9' are turned on.

When the ninth transistor M9' is turned on, the voltage of the first power source VGH is supplied to the second node N2'. When the voltage of the first power source VGH is supplied to the second node N2', the second transistor M2' and the sixth transistor M6' are turned on.

If the second transistor M2' is turned on, the first output terminal 105 and the second power input terminal 108 are electrically connected to each other, so that the voltage of the first power source VGH is supplied to the first output terminal 105.

When the third transistor M3' is turned on, the shift pulse SHP(i−1)' supplied to the first input terminal 101 is supplied to the third node N3' via the fourth transistor M4'. When the shift pulse SHP(i−1)' is supplied to the third node N3', the voltage of the third node N3' is increased to a high voltage, whereby the seventh transistor M7" is turned on.

Here, because the sixth transistor M6' and the seventh transistor M7" are set to the turned-on state, the voltage of the first node N1' is reduced to a voltage between the first power source VGH and the second power source VGL. In other words, the sixth transistor M6' and the seventh transistor M7" that have been set to the turned-on state may be equivalently replaced with resistances, and, in this case, the first node N1' may be set to a voltage between the first power source VGH and the second power source VGL.

At the first time t1, the second input terminal 102 and the first output terminal 105 are set to a high voltage (e.g., set to the voltage of the first power source VGH). Hence, even when the voltage of the first node N1' is increased, the first transistor M1' is maintained in the turned-off state.

When the third nod N3' is increased to a high voltage, the fifth transistor M5' is turned on. When the fifth transistor M5' is turned on, the fourth node N4' and the fourth input terminal 104 are electrically coupled to each other. Here, because the fourth clock signal CLK4' is not supplied to the fourth input terminal 104, the fourth input terminal 104 is set to a low voltage, so that the eighth transistor M8' is maintained in a turned-off state.

At a second time t2, the first clock signal CLK1' is supplied to the second input terminal 102, and the fourth clock signal CLK4' is supplied to the fourth input terminal 104.

If the fourth clock signal CLK4' is supplied to the fourth input terminal 104, the voltage of the fourth node N4' is increased to a high voltage. When the voltage of the fourth node N4' is increased to the high voltage, the eighth transistor M8' is turned on. When the eighth transistor M8' is turned on, the voltage of the second power source VGL is supplied to the second node N2'. Hence, the sixth transistor M6' and the second transistor M2' are turned off.

If the voltage of the fourth node N4' is increased to the high voltage, the voltage of the third node N3' is further increased by coupling of the second capacitor C2'. For example, the voltage of the third node N3' may be increased to a voltage higher than that of the first power source VGH. When the voltage of the third node N3' is increased, the seventh transistor M7" is completely turned on.

When the seventh transistor M7" is turned on, the voltage of the first node N1' is increased to the voltage of the first power source VGH. When the voltage of the first node N1' is increased to the voltage of the first power source VGH, the first transistor M1' is turned on. When the first transistor M1' is turned on, the second input terminal 102 and the first output terminal 105 are electrically coupled to each other.

Then, the first clock signal CLK1' supplied to the second input terminal 102 is supplied to the first output terminal 105. The first clock signal CLK1' supplied to the first output terminal 105 is supplied to a scan line as a scan signal SSi.

As described above, in an embodiment of the present disclosure, a low-level scan signal SSi may be supplied using N-type transistors. In addition, when the voltage of the third node N3' is increased to a voltage higher than that of the first power source VGH, the characteristics of the seventh transistors M7" may be stably maintained.

At a third time t3, the supply of the fourth clock signal CLK4' is interrupted (e.g., stopped). When the supply of the fourth clock signal CLK4' is interrupted (e.g., stopped), the voltage of the fourth input terminal 104 is reduced to a low voltage, so that the voltage of the fourth node N4' is set to a low voltage. When the voltage of the fourth node N4' is set to the low voltage, the eighth transistor M8' is turned off. Here, the voltage of the second node N2' is maintained at the voltage of the preceding period by the third capacitor C3', etc. When the voltage of the fourth node N4' is set to the low voltage, the voltage of the third node N3' is reduced by coupling of the second capacitor C2'.

At a fourth time t4, the supply of the first clock signal CLK1' is interrupted (e.g., stopped). When the supply of the first clock signal CLK1' is interrupted (e.g., stopped), the voltage of the second input terminal 102 is increased from the low voltage to the high voltage. Then, a high voltage is supplied to the first output terminal 105, whereby the supply of the scan signal SSi is interrupted (e.g., stopped).

If the voltage of the second input terminal 102 is increased from the low voltage to the high voltage, the voltage of the first node N1' is increased by coupling of the first capacitor C1'. When the voltage of the first node N1' is increased, the first transistor M1' is maintained in the turned-on state, whereby a high voltage may be reliably supplied to the first output terminal 105.

At a fifth time t5, the third clock signal CLK3' is supplied to the third input terminal 103. When the third clock signal CLK3' is supplied to the third input terminal 103, the third transistor M3' and the ninth transistor M9' are turned on.

When the ninth transistor M9' is turned on, the voltage of the first power source VGH is supplied to the second node N2'. When the voltage of the first power source VGH is supplied to the second node N2', the second transistor M2' and the sixth transistor M6' are turned on.

If the second transistor M2' is turned on, the first output terminal 105 and the second power input terminal 108 are electrically connected to each other, so that the voltage of the first power source VGH is supplied to the first output terminal 105.

If the sixth transistor M6' is turned on, the voltage of the second power source VGL is supplied to the first node N1'. Hence, the first transistor M1' is turned off.

When the third transistor M3' is turned on, the low voltage of the first input terminal 101 is supplied to the third node N3'. When the low voltage is supplied to the third node N3', the seventh transistor M7" is set to the turned-off state. Then, after the fifth time t5, the first transistor M1' is set to the turned-off state, and the second transistor M2' is set to the turned-on state. Consequently, the first output terminal 105 is reliably maintained at the voltage of the first power source VGH.

When the voltage of the second node N2' is set to a low voltage, the eleventh transistor M11' is turned on. When the eleventh transistor M11' is turned on, the fourth input terminal 104 and the gate electrode of the tenth transistor M10' are electrically coupled to each other.

Then, the tenth transistor M10' is turned on each time the fourth clock signal CLK4' is supplied to the fourth input terminal 104. When the tenth transistor M10' is turned on, the voltage of the second power source VGL is supplied to the fourth node N4'. In other words, in an embodiment of the present disclosure, the fourth node N4' may be periodically supplied with the voltage of the second power source VGL.

Hence, a ripple (e.g., a voltage ripple) is prevented or substantially prevented from being generated on the fourth node N4', whereby the driving stability of the stage circuit may be secured or improved.

When the voltage of the second node N2' is set to the low voltage, the twelfth transistor M12' is turned on. When the twelfth transistor M12' is turned on, the third capacitor C3' is electrically coupled to the fourth input terminal 104. Then, the voltage of the second node N2' is increased by coupling of the third capacitor C3' when the fourth clock signal CLK4' is supplied to the fourth input terminal 104. Thereby, the second transistor M2' may be reliably set to the turned-on state.

Figure 9:
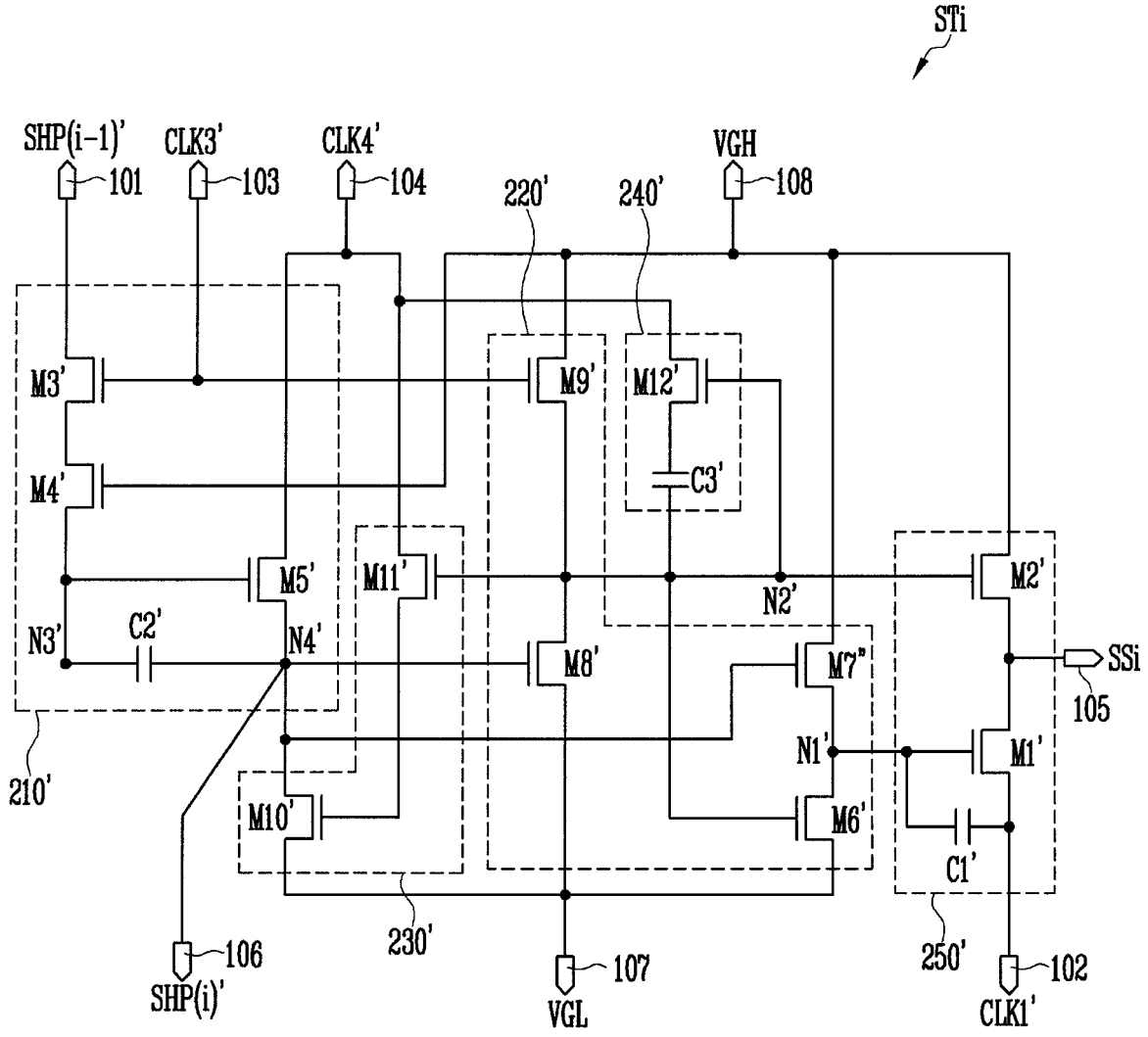
FIG. 9 is a circuit diagram illustrating an embodiment of the i-th stage circuit shown in FIG. 3.

In an embodiment of the present disclosure, as shown in FIG. 9, a gate electrode of a seventh transistor M7" may be coupled to a fourth node N4'. In this case, other than the fact that the seventh transistor M7" is turned on or off in response to the voltage of the fourth node N4, the operation process of the stage circuit STi is substantially the same as that of the embodiment of FIG. 7; therefore, detailed description may not be repeated.

In a stage circuit and a scan driver using the stage circuit in accordance with an embodiment of the present disclosure, a high-level scan signal may be outputted using the stage circuit formed of a P-type transistor. Furthermore, in an embodiment of the present disclosure, a low-level scan signal may be outputted using a stage circuit formed of an N-type transistor. In addition, in an embodiment, the driving stability of the stage circuit may be secured or improved by periodically initializing at least one or more nodes included in the stage circuit.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

In addition, it will also be understood that when a layer is referred to as being "between" two layers, it can be the only layer between the two layers, or one or more intervening layers may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The display device and/or any other relevant devices or components according to embodiments of the present invention described herein, such as the timing controller, data driver, scan driver, and emission driver, may be implemented utilizing any suitable hardware, firmware (e.g. an application-specific integrated circuit), software, or a suitable combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on a same substrate. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

Example embodiments have been disclosed herein, and although specific terms are employed, they are to be interpreted in a generic and descriptive sense and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various suitable changes in form and details may be made without departing from the spirit and scope of the present disclosure as defined by the following claims, and equivalents thereof.

What is claimed is:

1. A stage circuit comprising:

an output circuit configured to supply, to a first output terminal, either a first clock signal supplied to a second input terminal or a voltage of a second power source supplied to a second power input terminal, in response to voltages of a first node and a second node;

an input circuit coupled to the second power input terminal and configured to control voltages of a third node and a fourth node in response to a shift pulse of a previous stage circuit or a gate start pulse supplied to a first input terminal, a third clock signal supplied to a third input terminal, and a fourth clock signal supplied to a fourth input terminal;

a first driver coupled to both a first power input terminal and the second power input terminal, the first power input terminal being configured to receive a voltage of a first power source, the first driver being configured to control the voltages of the first node and the second node in response to both the third clock signal and the voltages of the third node and the fourth node;

a second driver coupled to the first power input terminal and configured to supply the voltage of the first power source to the fourth node in response to both the fourth clock signal and the voltage of the second node; and a third driver configured to control the voltage of the second node in response to both the fourth clock signal and the voltage of the second node.

2. The stage circuit according to claim 1, further comprising a second output terminal coupled to the fourth node and configured to supply the voltage of the fourth node as a shift pulse to a subsequent stage circuit.

3. The stage circuit according to claim 1, wherein the output circuit comprises:

a first transistor coupled between the second input terminal and the first output terminal, and comprising a gate electrode coupled to the first node;

a second transistor coupled between the first output terminal and the second power input terminal, and comprising a gate electrode coupled to the second node; and a first capacitor coupled between the second input terminal and the first node.

4. The stage circuit according to claim 3, wherein the first capacitor is a parasitic capacitor of the first transistor or a separate external capacitor.

5. The stage circuit according to claim 1, wherein the input circuit comprises:

a third transistor and a fourth transistor coupled in series between the first input terminal and the third node;

a fifth transistor coupled between the fourth node and the fourth input terminal, and comprising a gate electrode coupled to the third node; and a second capacitor coupled between the third node and the fourth node, and wherein the third transistor comprises a gate electrode coupled to the third input terminal, and the fourth transistor comprises a gate electrode coupled to the second power input terminal.

6. The stage circuit according to claim 1, wherein the first driver comprises:

a sixth transistor coupled between the first power input terminal and the first node, and comprising a gate electrode coupled to the second node;

a seventh transistor coupled between the first node and the second power input terminal, and comprising a gate electrode coupled to the third node;

an eighth transistor coupled between the first power input terminal and the second node, and comprising a gate electrode coupled to the fourth node; and a ninth transistor coupled between the second node and the second power input terminal, and comprising a gate electrode coupled to the third input terminal.

7. The stage circuit according to claim 1, wherein the first driver comprises:

a sixth transistor coupled between the first power input terminal and the first node, and comprising a gate electrode coupled to the second node;

a seventh transistor coupled between the first node and the second power input terminal, and comprising a gate electrode coupled to the fourth node;

an eighth transistor coupled between the first power input terminal and the second node, and comprising a gate electrode coupled to the fourth node; and a ninth transistor coupled between the second node and the second power input terminal, and comprising a gate electrode coupled to the third input terminal.

8. The stage circuit according to claim 1, wherein the second driver comprises:

a tenth transistor coupled between the first power input terminal and the fourth node; and an eleventh transistor coupled between a gate electrode of the tenth transistor and the fourth input terminal, and comprising a gate electrode coupled to the second node.

9. The stage circuit according to claim 1, wherein the third driver comprises:

a third capacitor comprising a first terminal coupled to the second node; and a twelfth transistor coupled between a second electrode of the third capacitor and the fourth input terminal, and comprising a gate electrode coupled to the second node.

10. The stage circuit according to claim 1, wherein the output circuit, the input circuit, the first driver, the second driver, and the third driver comprise P-type transistors, and wherein the first power source is set to a voltage higher than that of the second power source.

11. The stage circuit according to claim 1, wherein the output circuit, the input circuit, the first driver, the second driver, and the third driver comprise N-type transistors, and wherein the first power source is set to a voltage lower than that of the second power source.

12. A scan driver comprising stage circuits coupled to respective scan lines, an i-th (i being a natural number) stage circuit of the stage circuits comprising:

an output circuit configured to supply, to a first output terminal, either a first clock signal supplied to a second input terminal or a voltage of a second power source supplied to a second power input terminal, in response to voltages of a first node and a second node;

an input circuit coupled to the second power input terminal and configured to control voltages of a third node and a fourth node in response to a shift pulse of a previous stage circuit or a gate start pulse supplied to a first input terminal, a third clock signal supplied to a third input terminal, and a fourth clock signal supplied to a fourth input terminal;

a first driver coupled to both a first power input terminal and the second power input terminal, the first power input terminal being configured to receive a voltage of a first power source, the first driver being configured to control the voltages of the first node and the second node in response to both the third clock signal and the voltages of the third node and the fourth node;

a second driver coupled to the first power input terminal and configured to supply the voltage of the first power source to the fourth node in response to both the fourth clock signal and the voltage of the second node; and a third driver configured to control the voltage of the second node in response to both the fourth clock signal and the voltage of the second node.

13. The scan driver according to claim 12, wherein, when the i-th stage circuit is a first stage circuit, wherein the gate start pulse is supplied to the first input terminal, and wherein, when the i-th stage circuit is a stage circuit other than the first stage circuit, supply of the shift pulse starts from an i-1-th stage circuit.

14. The scan driver according to claim 12, further comprising:

a second output terminal coupled to the fourth node and configured to supply the voltage of the fourth node as a shift pulse to an i+1-th stage circuit.

15. The scan driver according to claim 12, wherein a second clock signal is supplied to a second input terminal of the i+1-th stage circuit, the fourth clock signal is supplied to a third input terminal of the i+1-th stage circuit, and the third clock signal is supplied to a fourth input terminal of the i+1-th stage circuit.

16. The scan driver according to claim 15, wherein the first clock signal and the second clock signal have an identical cycle, and the second clock signal has a ½-cycle phase difference relative to the first clock signal.

17. The scan driver according to claim 16, wherein a low level period of the third clock signal overlaps a high level period of the second clock signal.

18. The scan driver according to claim 16, wherein a low level period of the fourth clock signal overlaps a high level period of the first clock signal.

* * * * *